United States Patent [19]

Eskeli

[11] 4,077,230

[45] * Mar. 7, 1978

[54] ROTARY HEAT EXCHANGER WITH COOLING

[76] Inventor: Michael Eskeli, 7994-41 Lacke Lee, Houston, Tex.

[ * ] Notice: The portion of the term of this patent subsequent to Jan. 20, 1993, has been disclaimed.

[21] Appl. No.: 474,729

[22] Filed: May 30, 1974

Related U.S. Application Data

[63] Continuation-in-part of Ser. No. 361,281, May 17, 1973, abandoned.

[51] Int. Cl.[2] ..... F25B 3/00

[52] U.S. Cl. ..... 62/401; 62/499; 62/501; 415/1

[58] Field of Search ..... 62/401, 499, 500, 501; 415/1

[56] References Cited

U.S. PATENT DOCUMENTS

| | | | |
|---|---|---|---|
| 2,490,064 | 12/1949 | Kollsman | 62/401 |
| 2,490,065 | 12/1949 | Kollsman | 62/401 |
| 2,522,781 | 9/1950 | Exner | 62/499 |
| 2,529,765 | 11/1950 | Exner | 62/499 |
| 3,470,704 | 10/1969 | Kantor | 62/499 X |
| 3,808,828 | 5/1974 | Kantor | 62/499 X |
| 3,861,147 | 1/1975 | Eskeli | 165/86 X |
| 3,874,190 | 4/1975 | Eskeli | 62/401 |
| 3,919,845 | 11/1975 | Eskeli | 415/1 X |
| 3,933,008 | 1/1976 | Eskeli | 62/401 |

*Primary Examiner*—Charles J. Myhre
*Assistant Examiner*—Sheldon Richter

[57] ABSTRACT

A method and apparatus for the transfer of heat at a lower temperature to another fluid at a higher temperature, using a rotary heat exchanger and circulating the two fluids through said heat exchanger wherein a third fluid is circulated. The third fluid is normally a gas, compressed within the rotor by centrifugal action, with accompanying temperature increase, and heat is removed from said third fluid to a second fluid during and after compression; heat is added to said third fluid from a first fluid during and after expansion. A fourth fluid may be also circulated within said rotor, for removing heat from said third fluid before and during early part of compression to increase the weight of said third fluid within the compression side of the said rotor, thus improving the circulation of said third fluid within said rotor. Said second fluid, said first fluid, and said fourth fluid may be either liquids or gases as desired, including water. Said third fluid may be carbon dioxide.

3 Claims, 5 Drawing Figures

ROTARY HEAT EXCHANGER WITH COOLING

CROSS REFERENCES TO RELATED APPLICATIONS

This application is a Continuation-in-part application, of "Heat-Exchanger with Three Fluids", filed May 17, 1973, Serial No. 361,281, now abandoned.

BACKGROUND OF THE INVENTION

This invention relates to devices for producing heating and cooling, wherein one fluid releases heat and is thus cooled, and another fluid gains heat and is thus heated.

DESCRIPTION OF THE PRIOR ART

The art of producing heating and cooling has seen a variety of devices. In some of those devices, heat is generated by burning a fuel within a device, and the heat produced by this chemical reaction is transferred to a fluid being circulated in conduits in heat exchange relationship with said heating substance.

The main disadvantage of these conventional systems is that they require large amounts of fuel to generate the needed high temperatures to vaporize a fluid, and also require a large amount of power to produce a predetermined amount of cooling.

DESCRIPTION OF PREFERRED EMBODIMENTS

It is an object of this invention to provide means for removing heat from a third fluid being circulated within a rotor before and during compression thus providing for increased density for said third fluid and thus increasing the weight of said third fluid within the compression side of said rotor, which may be necessary for many fluids when used as said third fluids for increased capability of heat removal during and after compression from said third fluid into a second fluid.

Figure 1:
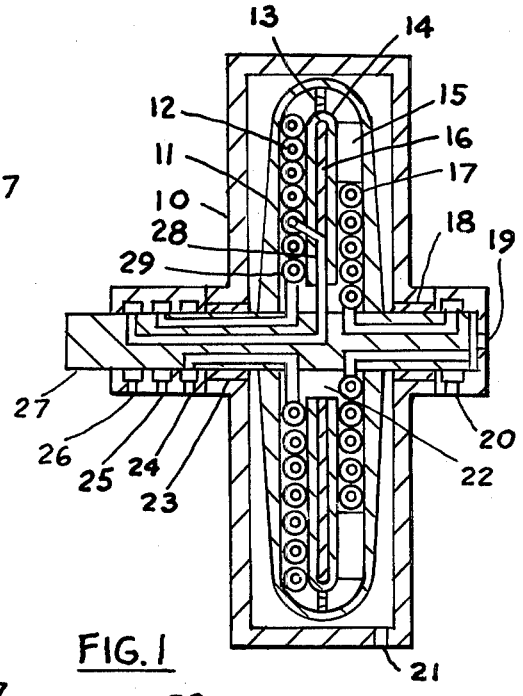

Referring to FIG. 1, therein is shown a cross section of a form of the device, where 10 is casing, 11 is rotor, 12 is second fluid heat exchanger, 13 are openings or nozzles, 14 is rotor divider, 15 is vane on rotor expansion and deceleration side, 16 is thermal insulation within rotor divider, 17 is first fluid heat exchanger, 18 is rotor shaft bearing and seal, 19 is first fluid exit, 20 is first fluid entry, 21 is casing vent, 22 is third fluid passage near rotor center, 23 is rotor shaft bearing and seal, 25 is second fluid entry, and 24 and 26 are second fluid exits, 27 is rotor shaft, 29 indicates a portion of second fluid heat exchanger used for cooling said third fluid, and 28 is second fluid conduit.

Figure 2:
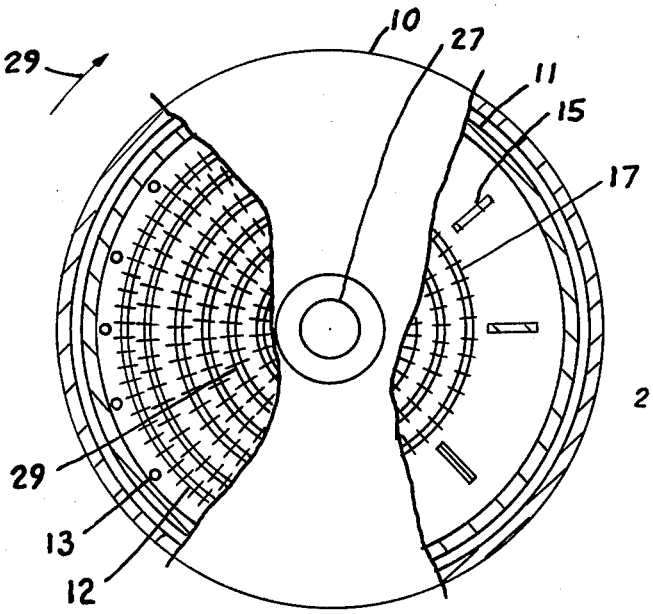
FIG. 1 is a cross section of a form of the device for producing said heating and FIG. 2 is an end view of the unit shown in FIG. 1.

In FIG. 2, an end view of the unit shown in FIG. 1 is illustrated, with portions removed to show internal details. 10 is casing, 11 is rotor, 27 is rotor shaft, 15 is vane, 17 is first fluid heat exchanger, 12 is second fluid heat exchanger, 13 are third fluid passage openings or nozzles, 29 is portion of second fluid heat exchanger, 28 indicates conduit for discharging a portion of said second fluid, 29 indicates direction of rotation of rotor.

Figure 3:
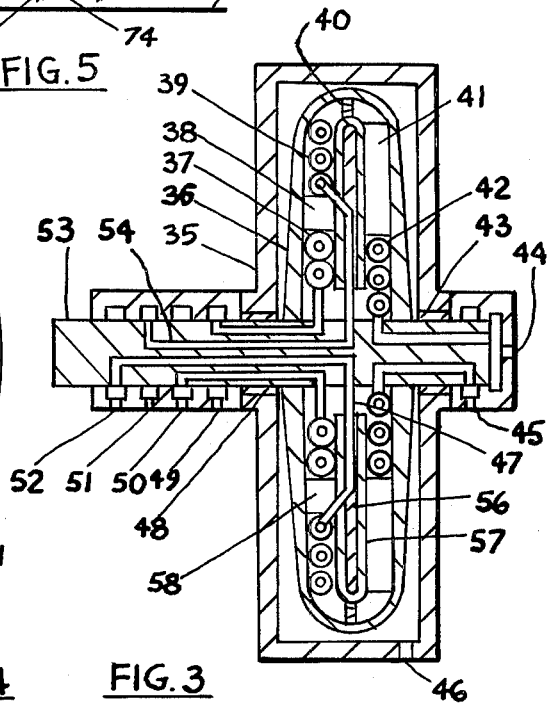
FIG. 3 is a cross section of another form of the device.

In FIG. 3, a cross section of another form of the device is shown. 35 is casing, 36 is rotor, 37 is cooling heat exchanger for removing heat from third fluid before and during early part of compression by circulating a fourth fluid within said heat exchanger 37, 38 is second fluid conduit, 39 is second fluid heat exchanger, 40 is third fluid passage opening or nozzle, 41 is vane, 42 is first fluid heat exchanger, 43 and 48 are shaft 53 bearings and seals, 44 and 45 are first fluid entry and exit, 56 is thermal insulation within rotor divider wall 57, 46 is casing vent, 58 is vane, 47 is third fluid passage from deceleration side to acceleration side, 49 and 50 are fourth fluid entry and exit, 51 and 52 are second fluid entry and exit, and 54 is second fluid conduit within rotor shaft.

Figure 4:
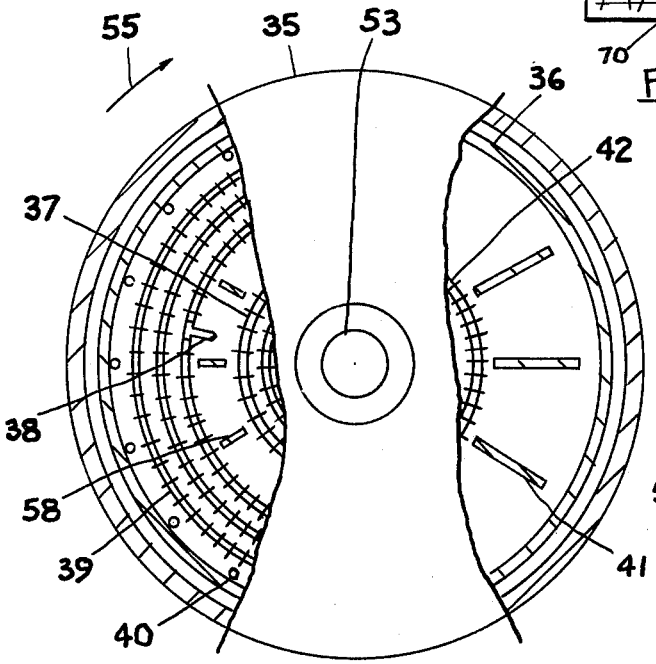
FIG. 4 is an end view of the unit shown in FIG. 3.

In FIG. 4, an end view of the unit shown in FIG. 3, is illustrated. 35 is casing, 53 is rotor shaft, 36 is rotor, 42 is first fluid heat exchanger, 41 is vane, 40 is third fluid opening or nozzle, 39 is second fluid heat exchanger, 58 are vanes, 38 is second fluid conduit, 37 fourth fluid heat exchanger, 55 indicates direction of rotation of rotor.

Figure 5:
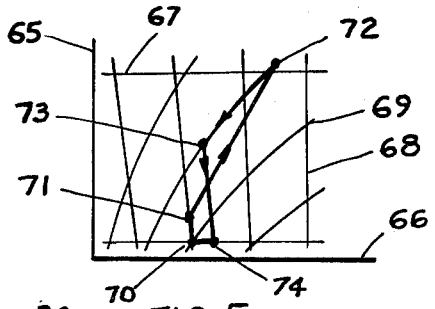
FIG. 5 is a pressure enthalpy diagram for a typical third fluid with the work cycle for said fluid superimposed thereon.

In FIG. 5, a pressure-enthalpy diagram for a typical third fluid is illustrated, with 65 being the pressure line and 66 being the enthalpy line, 67 are constant pressure lines, 68 are constant temperature lines, and 69 are constant entropy lines. The working cycle of said third fluid is superimposed thereon, and compression is shown from 70 to 71 approximately isothermally with said fourth fluid providing the necessary cooling, from 71 to 72 the compression is with some cooling, and said second fluid provides here the cooling, expansion is from 72 to 73 isentropically, and from 73 to 74 with heat addition with heat being provided from said first fluid, and then from 74 to 70 with cooling, where said cooling is provided by said fourth fluid.

In operation, said third fluid is compressed by centrifugal force within said rotating rotor, with accompanying temperature increase. During said compression, during later part of said compression, heat is removed from said third fluid to said second fluid with said second fluid being circulated within said second fluid heat exchanger in heat exchange relationship with said third fluid. After compression and said heat transfer, said third fluid is decelerated with accompanying pressure and temperature decrease with suitable vanes assuring that said third fluid will rotate with said rotor for recovery of work associated with said deceleration. During latter part of said deceleration, after suitable reduction of said temperature of said third fluid, heat is added to said third fluid from said first fluid being circulated in heat exchange relationship with said third fluid. After said heat addition, said third fluid is passed again to be accelerated and thus compressed. During early part of said compression, heat is removed from said third fluid by circulating a fourth fluid within a fourth fluid heat exchanger in heat exchange relationship with said third fluid; also, heat may be removed by said fourth fluid from said third fluid before said compression. After further acceleration and compression, heat is transferred to said second fluid, thus completing the work cycle for said third fluid.

An alternate method of providing cooling for said third fluid before and during early part of said compression is shown in FIG. 1, where a part of said second fluid is employed as a coolant for said third fluid. A portion of said second fluid is discharged via conduit 28, and the remainder of said second fluid then continues to receive heat and is then discharged as the heated second fluid via another exit 24.

Cooling of the said third fluid from 74 to 71, FIG. 5, is often required to balance the third fluid weight on the acceleration and deceleration sides of said rotor, so that the weight of said third fluid is greater on the acceleration and compression side of said rotor than on said deceleration and expansion side of said rotor. By providing additional cooling before and during early part of said compression, the third fluid density is increased and thus its weight is increased during said compression. This is necessary with many gaseous fluids when used as said third fluid, and in particular, it is necessary when the amount of said second fluid being circulated is relatively small during the latter part of said compression of said third fluid. Normally, the amount of said second fluid circulated is small when high final temperatures of said second fluid are desired, and when the amount of said third fluid being circulated is large when compared to the amount of said fluid being circulated.

Further, when the form shown in FIG. 3 is used, the entering temperature of said second fluid may be high, since the necessary cooling for said third fluid is provided by said fourth fluid.

The rotor is normally made of high strength materials to provide for high speed capability. The heat exchangers may be made of finned tubing as shown. The casing is usually evacuated to provide for elimination of drag on rotor outer surfaces. Power is provided to rotor shaft to rotate said rotor from an external source.

The third fluid is sealed within said rotor and is circulated therein by providing for placement of said heat exchangers such that the weight of said third fluid is greater on the said acceleration side of said rotor than on said deceleration side of said rotor, thus creating a pressure differential, necessary for transporting said third fluid within said rotor.

The said third fluid is normally a gas, such as carbon dioxide, or some other gas. The said second fluid, first fluid and fourth fluid may be either a gas or a liquid; typical fluid is water. Heat is supplied by said first fluid into said third fluid, and then said heat is transferred at a higher temperature to said second fluid, and from there to a use point. Work is supplied to accelerate said fluids within said rotor, and work is recovered when said fluids decelerate within said rotor.

The said first fluid, second fluid and said fourth fluid, are supplied from external sources, at suitable temperatures.

In FIG. 1, item 13 is a nozzle or opening in the divider for passing said third fluid from the compression side of said rotor to expansion side of said rotor. These passages 13 may be plain openings, or they may be used to regulate the flow of said third fluid within said rotor. Further, said passages may be made into nozzles oriented to discharge said third fluid in a desired direction, which may be backward or forward. When discharging said third fluid backward away from direction of rotation, the absolute tangential velocity of said third fluid is reduced, and thus the pressure on the expansion side of the rotor is reduced thus assisting in the circulation of said third fluid. When said passages 13 are nozzles oriented to discharge said third fluid forward to the direction of rotation, the absolute tangential velocity of said third fluid is increased, and this velocity increase will result in an increased work output by the expansion side of said rotor, thus reducing the work input to rotor shaft from external sources. The use of the passages 13 as nozzles, is dependent of the temperature differentials available between the coolant fluid which is said fourth fluid or entering second fluid, and the heating fluid which is said first fluid. For a close temperature differential between said fluids, said nozzles may be arranged for backward discharge, and for a large temperature differential, said nozzles may be arranged to discharge forward thus reducing or eliminating the need for an external power source to rotate said rotor.

Various controls and governors may be used with the device of this invention. They do not form a part of this invention and are not further described herein.

I claim:

1. In a rotary heat exchanger, comprising a rotatably mounted rotor, said rotor having first and second passages extending continuously outwardly from the axis of rotation of said rotor, passage means for connecting the outer ends of said first and said second passages, passage means for connecting the inner ends of said first and said second passages, to allow a fluid to flow outwardly and be compressed in said first passage and to flow inwardly and expand toward the center of rotation in said second passage, a compressible fluid within said passages, a first heat exchanger carried by said rotor for removing heat from said fluid and being at least in part adjacent to the outer end of said first passage and being at least in part adjacent to the outer end of said second passage, a second heat exchanger carried by said rotor and located in the second passage for adding heat into said fluid, the improvement comprising a third heat exchanger carried by said rotor adjacent to the inner ends of said first passage, for removing heat from said fluid as it enters the first passage.

2. The rotary heat exchanger of claim 1 wherein said third heat exchanger is a part of said first heat exchanger being in the part of said first heat exchanger nearest to the inner ends of said first and said second passages.

3. In a rotary heat exchanger, comprising a rotatably mounted rotor, said rotor having first and second passages extending continuously outwardly from the axis of rotation of said rotor, passage means for connecting the outer ends of said first and said second passages, passage means for connecting the inner ends of said first and said second passages, to allow a fluid to flow outwardly and be compressed in said first passage and to flow inwardly and expand toward the center of rotation in said second passage, a compressible fluid within said passages, a first heat exchanger carried by said rotor for removing heat from said fluid and being at least in part adjacent to the outer end of said first passage and being at least in part adjacent to the outer end of said second passage, a second heat exchanger carried by said rotor and located in the second passage for adding heat into said fluid, the improvement comprising a third heat exchanger carried by said rotor adjacent to the inner ends of said first passage for removing heat from said fluid downstream from said second heat exchanger.

* * * * *